US006561729B1

(12) United States Patent
Potts

(10) Patent No.: US 6,561,729 B1
(45) Date of Patent: May 13, 2003

(54) COMPACTING DRUM FOR A WORK MACHINE

(75) Inventor: Dean R. Potts, Maple Grove, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 10/020,148

(22) Filed: Dec. 14, 2001

(51) Int. Cl.[7] ..... E01C 19/26; E01C 19/38
(52) U.S. Cl. ..... 404/117; 404/122; 404/132
(58) Field of Search ..... 404/117, 122, 404/132

(56) References Cited

U.S. PATENT DOCUMENTS

| | | | | | |
|---|---|---|---|---|---|
| 941,309 | A | | 11/1909 | Colt | |
| 1,738,490 | A | | 12/1929 | Worley | |
| 2,169,916 | A | | 8/1939 | Keeler | |
| 2,437,524 | A | | 3/1948 | Harrison et al. | |
| 2,549,182 | A | * | 4/1951 | Ekenstam | 404/130 |
| 2,617,488 | A | | 11/1952 | Marshall | |
| 2,691,927 | A | | 10/1954 | Denton | |
| 3,052,167 | A | | 9/1962 | Beale | |
| 3,228,312 | A | | 1/1966 | Neidhardt et al. | |
| 3,298,292 | A | | 1/1967 | Wylie | |
| 3,309,972 | A | * | 3/1967 | Peters | 404/117 |
| 3,605,582 | A | * | 9/1971 | Kaltenegger | 404/117 |
| 3,897,165 | A | * | 7/1975 | Vural | 404/117 |
| 4,156,575 | A | * | 5/1979 | Konig et al. | 404/84.05 |
| 4,732,507 | A | * | 3/1988 | Artzberger | 404/117 |
| 4,927,289 | A | * | 5/1990 | Artzberger | 404/117 |
| 4,964,753 | A | * | 10/1990 | Ciminelli et al. | 404/122 |
| 5,390,495 | A | | 2/1995 | Lemaire | |
| 6,402,424 | B2 | * | 6/2002 | Mitsui | 404/117 |

OTHER PUBLICATIONS

HAMM—DV 6—Operating and Service Manual—HAMM Walzenfabrik GmbH D–8593 Tirscherreuth/West–Germany Postfach 1160, Telefon 09631/80–0, Telex 0631349 Edition 04 83; 4 pages, cover,Model Cover Page, letter pg, Eng Drawing.

* cited by examiner

*Primary Examiner*—Gary S. Hartmann
(74) *Attorney, Agent, or Firm*—Jeff A Greene

(57) ABSTRACT

A compacting drum for a work machine has first and second drum sections. The first and second coaxial drum sections rotate independently from one another. The first and second drum sections are coupled together by a controllable coupling arrangement that can be varied between fully coupled and fully uncoupled.

17 Claims, 3 Drawing Sheets

COMPACTING DRUM FOR A WORK MACHINE

TECHNICAL FIELD

The invention relates generally to asphalt and soil compacting work machines, and more particularly to a split drum design for such work machines.

BACKGROUND

Compacting work machines are commonly employed for compacting freshly laid asphalt, soil, and other compactable materials or substrates. For example these work machines may include plate type compactors or rolling drum compactors with one or more drums. The drum type work machines function to compact the material over which the machine is driven. In order to more efficiently compact the material the drum assembly often includes a vibratory mechanism for inducing vibratory forces on the material being compacted.

It is common practice in the compacting of asphalt to use work machines that include two rotating drums to more efficiently compact the material. Double drum compactors are used so that during each pass over the material being compacted each drum performs a portion of the compacting process. These double drum compactors either have an articulating frame or each drum has the ability to pivot about a vertical axis so that the work machine can be steered in a desired direction during operation. During tight turning operations the outside of the drum can slide over the material being compacted and causes a tear in the material because the outside portion of the drum desires to rotate faster than the inside portion. On the other hand the inside portion of the drum can plow or mound the asphalt because the tendency is for the inside portion of the drum to rotate slower than the outside portion. This is contrary to the goal of finishing a road surface that is smooth and flat.

Solutions in attempt to minimize the problem, as set forth above is to provide a drum that have first and second drum sections known as split drums. The split drum divides the width of a given drum in half allowing an outer drum section to rotate faster than an inner drum section during turning and other operations. Split drum designs are known in the art and often use a fixed friction pack to couple the two drum sections to one another. The frictional force of the friction packs must be overcome however before slip can occur between the drum sections. In operation however the split drums do not always operate in a predictable manner and slip between the sections occurs when not desired and often does not occur when slip is desired. Another attempt to address this problem is disclosed in U.S. Pat. No. 5,390,495 granted on Feb. 21, 1995 and assigned to Poclain Hydraulics. This patent teaches using independent drive motors to propel each drum section.

The present invention is directed at overcoming one or more of the problems as set forth above.

SUMMARY OF THE INVENTION

In one aspect of the present invention, a compacting drum for a work machine is provided. The compacting drum includes a first drum section and a second drum section positioned adjacent to the first drum section. A controllable coupling arrangement connects the first drum section to the second drum section.

DETAILED DESCRIPTION

Figure 1:
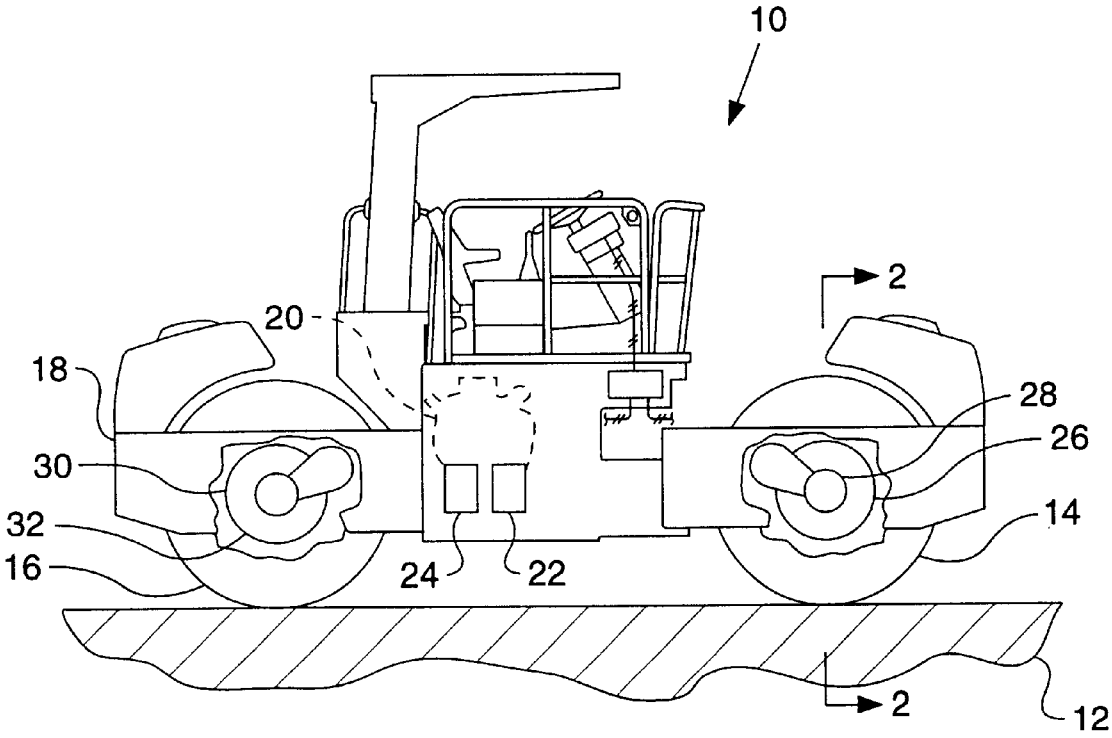
FIG. 1 is a side elevational view of a work machine embodying the present invention.

A work machine 10, for increasing the density of a compactable material or mat 12 such as soil, gravel, or bituminous mixtures is shown in FIG. 1. The work machine 10 is for example, a double drum vibratory compactor, having a first/front compacting drum 14 and a second/rear compacting drum 16 rotatably mounted on a main frame 18. The main frame 18 also supports an engine 20 that has a first and a second power source 22,24 conventionally connected thereto. Variable displacement fluid pumps or electrical generators can be used as interchangeable alternatives for the first and second power sources 22,24 without departing from the present invention.

The front drum 14 includes a first vibratory mechanism 26 that is operatively connected to a first motor 28. The rear drum 16 includes a second vibratory mechanism 30 that is operatively connected to a second motor 32. The first and second motors 28,32 are operatively connected, as by fluid conduits and control valves or electrical conductors neither of which are shown, to the first power source 22. It should be understood that the front and rear drums 14,16 could have more than one vibratory mechanism per drum.

Figure 2:
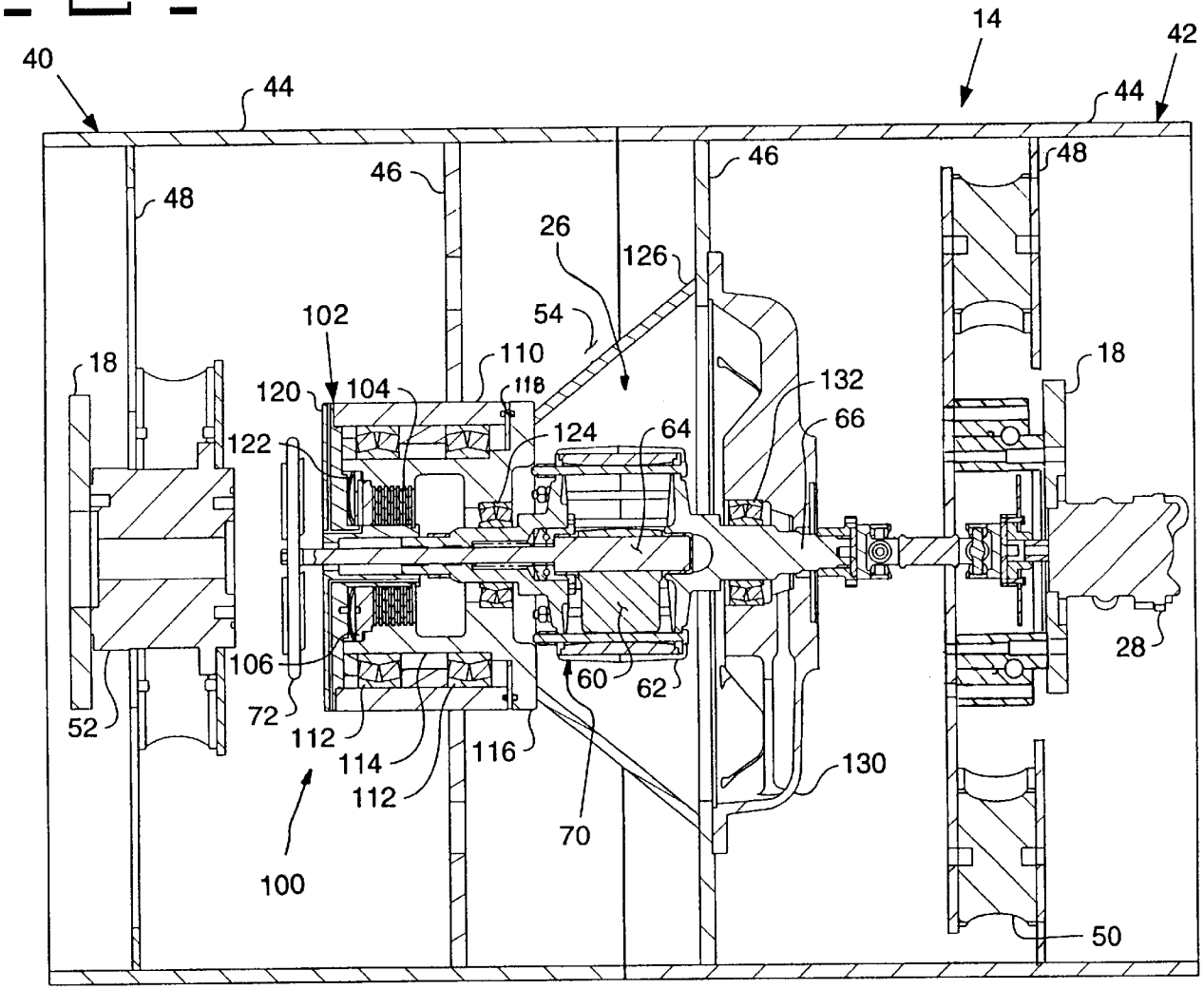
FIG. 2 shows an axial cross section view taken along line 2—2 through a compacting drum of the work machine of FIG. 1 embodying the present invention.

In as much as, the front drum 14 and the rear drum 16 are structurally and operatively similar. The description, construction and elements comprising the front drum 14, which will now be discussed in detail and applies equally to the rear drum 16. Referring now to FIG. 2, the front drum 14 includes a first and a second drum section 40,42. Each of the first and second drum sections 40,42 is made up of an outer shell 44 that is manufactured from a steel plate that is rolled and welded at the joining seam. An inner and outer bulkhead 46,48 is fixedly secured to the inside diameter of the outer shell 44 as by welding.

Rubber mounts 50 vibrationally isolate the front drum 14 from the main frame 18. A propel motor 52 is positioned between the main frame 18 and the first drum section 40. For example, the propel motor 52 is connected to the main frame 18, as by fasteners, and to the outer bulkhead 48 of the first drum section 40. The propel motor 52 additionally is operatively connected to the second power source 24 which, supplies a pressurized operation fluid or electrical current, to propel motor 52 for propelling the work machine 10.

Vibratory mechanism 26 is contained within an enclosed cavity 54 and is coaxially supported between the first and second drum sections 40,42 within the first compacting drum 14. The vibratory mechanism 26 includes a first/inner eccentric weight 60 and a second/outer eccentric weight 62 that are connected to an inner shaft 64 and an outer shaft 66 respectively. A cardan shaft 68 connects motor 28 to vibratory mechanism 26. Specifically, motor 28 supplies rotational input to the first vibratory mechanism.26 so as to impart a vibratory force on compacting drum 14. The vibratory mechanism 26 shown in FIG. 2 is an indexable vibratory mechanism 70 that can be indexed between a plurality of distinct amplitude settings via a hand wheel 72.

Figure 3:
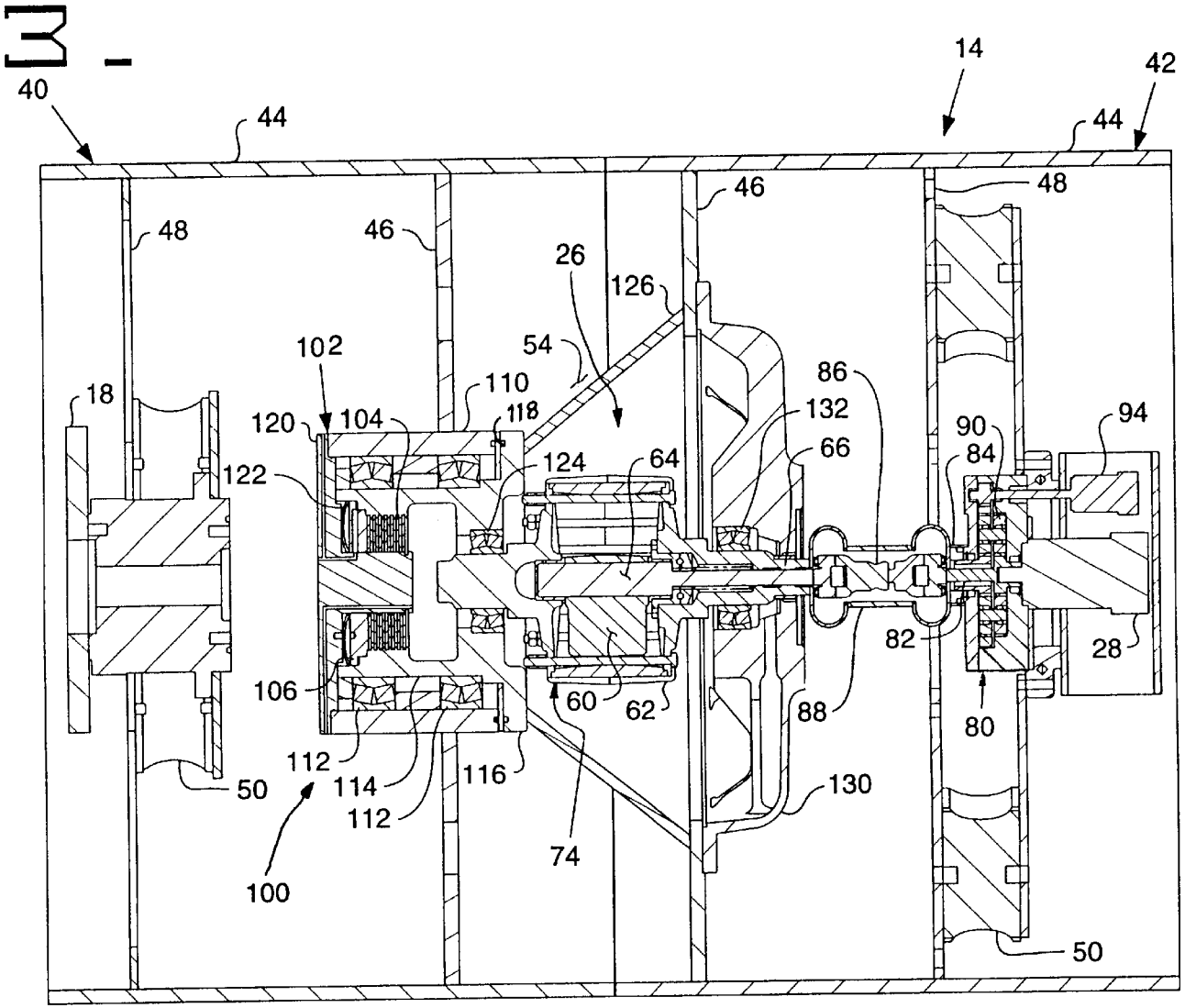
FIG. 3 shows an axial cross section view taken along line 2—2 through a compacting drum of the work machine of FIG. 1 showing an alternative embodiment of the present invention.

Referring now to FIG. 3, an infinitely variable vibratory mechanism 74 is shown with like numbers representing like elements from FIG. 2. A gearbox 80 has an inner drive shaft 82 and an outer drive/phase shaft 84. The inner drive shaft 82 is connected to an inner flexible coupling 86, and the outer phase shaft 84 is connected to an outer flexible coupling 88. The gearbox 80 includes a double planetary gear set 90 comprised of sun, planet and ring gears, however other numbers of planetary gear sets would work as well. An output shaft 92 of the motor 28 is connected to the gearbox 80 for supplying rotational input to the vibratory mechanism 74. A phase motor 94 is connected to the gearbox 80 and provides rotational input to the double planetary gear set 90 to change the phase between the first eccentric weight 60 and the second eccentric weight 62.

In reference now to FIGS. 2 and 3, a controllable coupling arrangement 100 is connected to the inner bulkheads 46 of the first and second drum sections 40,42. The controllable coupling arrangement 100 is a clutch 102 that is shown having a clutch pack 104 and a hydraulic piston 106. However it should be understood that an electrical clutch or any other arrangement for controllably coupling the first and second drum sections is considered to be within the scope of the invention. Controllably coupled in this example is defined as a device that is capable of being infinitely controlled between a condition where the first and second drum sections 40,42 are rigidly coupled to one another and a condition where the first and second drum sections 40,42 are completely uncoupled from one another.

Specifically, an outer housing 110 of the controllable coupling arrangement 100 is fixedly secured, as by welding to the inner bulkhead 46 of the first drum section 40. A pair of bearings 112, which are shown for example as being double row self-aligning bearings, are positioned on the inside diameter of the outer housing 110. The bearings 112 however could be any other known type of bearings that will handle the required preloads for this type of assembly. Bearings 112 rotatably support an inner housing 114 of the controllable coupling arrangement 100. Radially extending from one end of the inner housing 114 is a shoulder 116. The shoulder 116 abuts one end of the outer housing 110. A seal 118 is located in the shoulder 116 and the end of the outer housing 110. Secured, as by fasteners a (not shown), to the opposite end of the outer housing 110 is a cap 120.

Positioned in the inside diameter of the inner housing 114 opposite the shoulder 116 are the clutch pack 104 and the hydraulic piston 106. Coaxially located between the cap 120 and the hydraulic piston 106 is a biasing member 122 that biases the hydraulic piston 106 away from the cap 120. Positioned in the inside diameter in the other end of the inner housing 114 is a bearing 124 that supports one end of the outer shaft 66 of the vibratory mechanism 26. A frustoconical member 126 is fixedly secured to the inner housing 116 on a radially extending shoulder 128 adjacent to the roller bearing 116. Frustoconical member 126 is also secured to the inner bulkhead 46 of the second drum section 42. A housing member 130 is secured to the side the inner bulkhead 46 opposite of the frustoconical member 118. The other end of the outer shaft 66 is rotatably support by a bearing 132 positioned in a counter bore in the housing member 130.

INDUSTRIAL APPLICABILITY

In operation the controllable coupling arrangement 100 is used to control the coupling force between the first and second drum sections 40,42. This can be done either manually through any of a number of known operator controlled configurations (not shown), such as hydraulic or by using an electrical or electro-hydraulic system through the use of a controller. Specifically, the example shown and described uses the controllable coupling arrangement 100 to couple the first and second drum sections 40,42 together. The biasing member 122 pushes against the hydraulic piston 106 causing the clutch pack 104 to couple the inner housing 114 to the outer housing 110 thereby coupling the first and second drum sections 40,42. The controllable coupling arrangement 100 is released by applying pressurized fluid to the hydraulic piston 106 which works against the biasing member 122 allowing the inner housing 114 to rotate freely of the outer housing 110. By varying the pressure of the hydraulic fluid the coupling force that holds the first and second drums section 40,42 can be infinitely varied to a desired amount for any given situation.

Thus a controllable coupling arrangement 100 is provided for compacting drum 14 that can easily be controlled to provide a desired amount of coupling between first and second drum sections 40,42 from fully coupled to fully uncoupled.

What is claimed is:

1. A compacting drum for a work machine comprising:
   - a first drum section;
   - a second drum section coaxially positioned adjacent to said first drum section; and
   - a controllable coupling arrangement operatively connecting said first drum section and said second drum section said controllable coupling arrangement is infinitely controllable between a fully coupled and a fully uncoupled.

2. The compacting drum of claim 1, wherein the controllable coupling arrangement includes a clutch.

3. The compacting drum of claim 1, wherein the controllable coupling arrangement connects an inner bulkhead of said first drum section and an inner bulkhead of said second drum section.

4. The compacting drum of claim 3, wherein the controllable coupling arrangement includes an outer housing that is fixedly secured to said inner bulkhead of said first drum section.

5. The compacting drum of claim 4, wherein the controllable coupling arrangement includes an inner housing that is connected to said inner bulkhead of said second drum section.

6. The compacting drum of claim 5, including a pair of bearings positioned within said outer housing rotatably supporting said inner housing.

7. The compacting drum of claim 1, including a vibratory mechanism rotatably supported between said first and second drum sections.

8. The compacting drum of claim 7, wherein a first stub shaft of said vibratory mechanism is rotatably supported by an inner housing of said controllable coupling arrangement and a second stub shaft of said vibratory mechanism is rotatably supported by a housing fixedly connected to said second drum section.

9. The compacting drum of claim 7, wherein said vibratory mechanism is a variable vibratory mechanism.

10. The compacting drum of claim 7, wherein said vibratory mechanism is an infinitely variable vibratory mechanism.

11. A compacting drum for a work machine comprising:
   - a first drum section having an inner bulkhead and an outer bulkhead;
   - a second drum section having an inner bulkhead and an outer bulkhead, said second drum section being coaxially positioned adjacent to said first drum section; and
   - a controllable coupling arrangement operatively connecting said inner bulkhead of said first drum section and said inner bulkhead of said second drum section said controllable coupling arrangement is infinitely controllable between a fully coupled and a fully uncoupled.

12. The compacting drum of claim 11, including a vibratory mechanism rotatably supported between said first and second drum sections.

13. The compacting drum of claim 12, wherein a first stub shaft of said vibratory mechanism is rotatably supported by an inner housing of said controllable coupling arrangement and a second stub shaft of said vibratory mechanism is rotatably supported by a housing fixedly connected to said second drum section.

14. The compacting drum of claim 11, wherein the controllable coupling arrangement includes a clutch.

15. The compacting drum of claim 11, wherein the controllable coupling arrangement includes an outer housing of that is fixedly secured to said inner bulkhead of said first drum section.

16. The compacting drum of claim 15, wherein the controllable coupling arrangement includes an inner housing that is connected to said inner bulkhead of said second drum section.

17. The compacting drum of claim 16, including a pair of bearings positioned within said outer housing rotatably supporting said inner housing.

* * * * *